US007017834B2

(12) United States Patent
Santa Cruz et al.

(10) Patent No.: US 7,017,834 B2
(45) Date of Patent: Mar. 28, 2006

(54) LIQUID STORAGE, DISPENSING, MIXING, APPLICATION, SYSTEM AND METHOD OF US

(76) Inventors: Cathy D. Santa Cruz, 7630 Tholl Dr., Reno, NV (US) 89506; William E. Adams, 2570 Tacchino St., Reno, NV (US) 89512; Steven M. Waldren, 2570 Tacchino St., Reno, NV (US) 89512; Timothy B. Waldren, 2570 Tacchino St., Reno, NV (US) 89512; Phillip B. Waldren, 190 Stags Leap Cir., Sparks, NV (US) 89436; Sharon A. Waldren, 190 Stags Leap Cir., Sparks, NV (US) 89436; Allan E. Schultz, 2205 Vista Terace La., Sparks, NV (US) 89436

( * ) Notice: Subject to any disclaimer, the term of this patent is extended or adjusted under 35 U.S.C. 154(b) by 265 days.

(21) Appl. No.: 10/219,859

(22) Filed: Aug. 15, 2002

(65) Prior Publication Data

US 2004/0046051 A1 Mar. 11, 2004

(51) Int. Cl.
*B05B 7/30* (2006.01)

(52) U.S. Cl. ..... 239/345; 239/289

(58) Field of Classification Search ..... 239/345, 239/289

See application file for complete search history.

(56) References Cited

U.S. PATENT DOCUMENTS 6,439,480 B1 * 8/2002 Velde ..... 239/327
6,536,687 B1 * 3/2003 Navis et al. ..... 239/345

* cited by examiner

*Primary Examiner*—Christopher Kim

(57) ABSTRACT

A system that is used for control of various liquids, including storage, mixing and dispersing thereof, but more particularly pertains to an improved system that is suitable for use with substantially any type of liquid of user choice. The system is economical, simplified, environmentally friendly, and includes use of multipurpose container(s) that further include various components and/or attachments which allow for storage, mixing and dispensing there from.

34 Claims, 4 Drawing Sheets

LIQUID STORAGE, DISPENSING, MIXING, APPLICATION, SYSTEM AND METHOD OF USE

FIELD OF THE INVENTION

This invention relates in general to systems and/or apparatuses that are used for control of various liquids, including storage, mixing and dispersing thereof, but more particularly pertains to an improved system that is suitable for use with substantially any type of liquid of user choice. For example, such as paint, chemicals, water samples, pharmaceuticals, lacquer, etc. The system is economical, simplified, environmentally friendly, and includes use of multipurpose storage container(s) that further include various components and/or attachments which allow for storage, mixing and dispensing there from.

BACKGROUND OF THE INVENTION

Within the current existing known prior art, there have been numerous attempts to provide efficient liquid control systems. However each include inherent disadvantages and drawbacks which the present invention addresses and overcomes in a manner heretofore not taught. For example, some references of the known prior art include the following U.S. Pat. Nos. 4,926,390, 4,875,781 and 5,094,543, each of which are entitled "PAINT MIXING CONTAINER". Unfortunately each reference is only sufficient for mixing paint and cannot be easily used for proper storage once the container has been opened, nor do they allow for easy dispensing there from. Also each container uses a lid which inherently tends to accumulate paint thereon which is most inconvenient, very wasteful and not cost effective. Also, none of the references include and/or address disposal means which is environmentally friendly and/or acceptable.

It is to be understood that the present invention is usable with any type of liquid of user choice. However, the system as taught herein is especially useful in the auto paint industry, as will be seen within the following specification but it is not to be limited to such use. As the following is only exemplary of one possible scenario for use of the present invention.

In the automotive body repair industry, paint vendors provide auto body repair businesses, such as body shops and jobbers, with their paint formulas. Generally, these paint formulas are a composition (i.e., mixture) of paint components, such as colorants, tints, pearls, metalics, binders and/or balancers that once mixed, produce the desired color of paint to be applied to a repaired vehicle. The paint formulas of the paint vendors are formulated to match the colors that have been applied to vehicles by new car manufacturers over the years. In addition, these paint formulas include variants, to match the color fading of paint that can occur to a vehicle over years of service. Moreover, the palettes of paint formulas of the paint vendors also have custom colors (i.e., unconventional colors not typically used by vehicle manufacturers) that may be used to produce special finishes for custom or show cars. Hence, paint vendors provide body shops and jobbers with literally thousands of paint formulas for producing the vast spectrum of colors needed in the automotive body repair industry.

In the past, paint vendors would provide the body shops and jobbers with microfiche containing their paint formulas. Today the paint formulas are stored in computer memory. To determine the particular paint formula for a particular vehicle repair/paint job, a system operator, such as an employee of the body shop or jobber, first obtains the color code from the vehicle. This color code is typically part of the vehicle's identification number. In the case of an unconventional color, to be used to produce a custom paint finish, the code for a particular color is obtained from a catalog. This color code is then entered into the microprocessor of the computer, which accesses the computer memory, and displays, via a monitor, the paint vendor's paint formula which matches the identified vehicle color code.

The paint formulas are displayed according to the weight of the different paint components for mixing specific quantities of the paint formula, and the order in which the displayed paint components are to be mixed. Typically, paint formula mixing quantities are listed in quart, half gallon and gallon sizes, while the weight of the particular paint components needed to mix the desired quantity of paint, are listed in grams to a precision of a tenth of a gram. Generally, the paint components comprising tints, colorants, pearls and/or metallics are mixed first, while the paint components comprising binders and/or balancers are added last. Depending on the desired color, the paint formula can require just a few paint components, or over a dozen paint components, that must be mixed with a great degree of precision, to achieve a perfect color match.

Once the system operator determines that the correct desired paint formula is displayed on the computer monitor, the operator places a paint receptacle on a weigh cell that is linked to the microprocessor of the computer. Generally, a receptacle larger than the quantity of paint formula to be mixed is used to accommodate any excess paint inadvertently mixed by the operator. With the receptacle on the weigh cell, the weigh cell is zeroed by the operator, to make ready for the process of adding paint components to the receptacle to mix the desired color paint formula. Generally, the various paint components (of which there are dozens) are stored in containers kept within a rack. The rack has a mechanism that periodically stirs the paint components within the containers, so that the various paint components are ready to be dispensed as part of the paint formula mixing process. Typically, these containers are the original quart and gallon sized metal containers within which the paint components are shipped to the body shop or jobber. In metric system countries, these containers are the original one liter and four liter sized metal containers within which the paint components are shipped to the body shop or jobber. The original covers of these containers are replaced by specialized paint container lids which include stirring paddles that work with the stirring mechanism of the rack. These specialized paint container lids also have pour spouts that allow the paint components of the containers to be dispensed (i.e., poured out) into the receptacle atop the weigh cell. The pour spout of the specialized paint container lid is covered by a cover element that helps to protect the paint component within the container from contaminants. The cover element for the pour spout is movable between an opened state in which the paint component can be poured from its container through the pour spout by tipping (i.e., tilting) the container, and a closed state.

To reproduce the desired paint formula, the system operator begins by identifying the first listed paint component of the paint formula to be mixed. The operator then pours, by hand, the paint component into the weigh cell supported paint receptacle, until the weight of the paint component dispensed (i.e., poured) into the receptacle matches what is displayed on the computer monitor. The operator continues along on this course (i.e., hand pouring the paint components from their containers), until the correct weight of all paint components, needed to mix the desired color paint formula, have been added to the paint receptacle atop the weigh cell.

Although the above described system for mixing paint components (according to a paint formula), using the original containers of the liquid paint components and the above described specialized container lids, allows a skilled system operator to dispense the needed paint components to adequately recreate paint colors needed for repair/paint jobs, there are some disadvantages to this system. For example, there are at least two different types of paint component mixing racks for storing original containers of paint components. Each of these paint component mixing storage racks has a unique mixing system for stirring the liquid paint components within the original containers. As such, each of these unique mixing systems requires a unique lid member and associated stirring paddle device to allow the original container to be accommodated within the particular paint component mixing storage rack. Moreover, to mix a desired paint formula requires that the paint components be added to the paint receptacle, atop the weigh cell, with a great degree of accuracy. This accuracy, as stated earlier, is typically to a precision of 0.1 grams. For even a highly skilled operator this great degree of precision is difficult to obtain when hand pouring the paint components needed to mix the desired paint formula. It is especially difficult when many paint components must be poured into the paint receptacle in order to duplicate the paint formula.

The most common error on the part of the system operator of the body shop or jobber is over pouring which is due primarily to the manual "labor intensive" nature of the paint component dispensing process. Over pouring occurs when the weight of the paint component added to the receptacle atop the weigh cell, exceeds the weight of the component shown on the computer display for the desired paint formula. When this happens, the microprocessor of the computer recalculates the weights of the other paint components that need to be added to the receptacle to compensate for the over poured component. This recalculation is done automatically by the microprocessor since the weigh cell is linked to the computer. Based upon this recalculation, the system operator then needs to re-pour the other paint components to offset the over poured component of the paint formula.

While this re-pouring task may not be difficult when the paint formula only has a few paint components, the re-pouring task is particularly time consuming when there is a great number of components in the paint formula. Specifically, if an over pouring error is made in the last paint component of a series of ten components of a paint formula, then all of the previous nine components may have to be re-poured to compensate. This re-pouring task may be further complicated if another error is made during the re-pouring of the paint components, as this further error may require that some components be re-poured two or three times until the paint formula is finally accurately reproduced. Hence, over pouring errors can be costly to a body shop or jobber because of the additional "man hours" needed to mix the paint formula.

Not only are over pouring errors expensive because of the additional man hours needed to reproduce the paint formula, over pouring errors are also costly in the amount of additional paint formula that is mixed because of the errors. Automotive paint can cost in excess of $100.00 per quart. An over pouring error of just one pint may translate into an additional cost of $50.00 or more that a body shop or jobber may have to absorb, unless this additional paint cost can be justified to an automobile collision insurance carrier. Moreover, this additional paint, if not used in the repair/paint job, becomes a hazardous waste that must be disposed of properly, thereby adding still more costs that are attributable to paint component over pouring errors and the like.

To further clarify the novel features of the present invention, we herewith provide the following explanation that addresses the current methods available, the pros and cons, and the advantages of the present invention when compared to the known prior art.

Steps for Highest Usage Method in the US
(Current/Old Way)

Old way of mixing, spraying, cleaning and storage (in most cases still the only way of mixing, spraying, etc.)

1. Pull a tin can from original storage with lid (from cardboard shipping box)
2. Set tin can on mixing scale and mix paint formula inside can
3. Reduce mixed formula with Reducers and Hardeners
4. Grab paint gun from wall and take off lid of spray gun cup container and set paint strainer onto top of spray gun cup
5. Pour mixed formula from tin can to spray cup
6. Attach lid to spray cup—mixed formula is ready for initial spray out
7. To tint this mixed formula (70% of all formulas need to be tinted)
8. Set spray gun on stand and take spray cup lid off
9. Pour contents from spray gun back into tin can
10. Add color tints and mix together
11. Set strainer (paper) back on top of spray cup—causes spill on counter top
12. Pour mixed formula with tints from tin can to spray cup and set lid back on spray cup
13. This process in most cases will need to be done 3–times to achieve proper paint formula match
14. This process of pouring paint back and forth is messy, time consuming, and frustrating
15. Now that the color is matched the vehicle can be painted
16. Once the application of color is finished the paint needs to be poured back into the tin can
17. The lid for the tin can then needs to be put on the can to seal off
18. The lid needs to be hammered on to secure it and with paint in the rim from being poured back and forth, it splatters all over the walls and the painter himself making a mess and causing more frustration
19. Now the spray gun and cup need to be cleaned. The most labor intensive part of cleaning is cleaning the cup. This takes the most time (3–5 minutes) and is most expensive because it requires the most lacquer thinner
20. Now that the gun and cup are cleaned they are ready for the next use
21. If the owner wants touch up paint the tin can needs to be pulled from the storage shelf and a screwdriver is needed to open the tin can
22. The paint needs to be stirred
23. The paint needs to be poured from the tin can into a smaller touch up bottle—this again is time consuming, messy and frustrating
24. The tin can is then placed back into storage until it can be used again—which is highly unlikely—or until the mixed paint is disposed of
25. When disposing of the paint, the can needs to be taken from the shelf and the lid again opened with a screwdriver. The contents are then poured out into a larger can for off site treatment or poured into an onsite recycling system 26. The tin can may now be thrown away "another expense and waste" as each tin can may cost approximately $1.19 each.

Brief Description of Old and Current Way

It is a messy system to use. It is time consuming, costly, and extremely messy each time paint is poured back and forth between tin can and cup. Time consuming because of the pouring back and forth which includes numerous steps, the screwdriver needed to open the lid, and the cup clean up equals many, many steps. Expensive because the tin can must be thrown out, the material inside must be disposed of, and the cost of clean up of the cup.

Old Way Pro's and Con's

Old Way Pro's 1. 80% of painters in this country are familiar with this process and they are currently using this system.
2. To stay with this system, no re-training would be needed to inform of new product—no habits to re-learn, or break "If you always do what you've always done, you will always get what you always got."

Old way Con's

Expensive system—waste of tin can $1.19
purchase of touch up bottle $1.19
waste (disposal of paint waste)
clean up time $4.00
clean up methods $1.05

See previous lines 15, 18, and 19

Pro's of New System

Steps and material of the present invention system would be saved as follows:

1. Throwing away of the tin can after use
2. Paper strainers no longer needed
3. Steps of pouring paint materials back and forth from containers
4. Eliminates messy spills and clean up thereof
5. Eliminates using screwdriver to open can and hammering tin paint can lid closed
6. Eliminates paint splatter
7. Eliminates clean up time of paint cup and extra cleaning materials (paint thinner)
8. Eliminates purchase of extra touch up bottle Steps of Newest Way (Lower % of Usage in Shops in US)

1. Pull re-usable plastic cup from shelf
2. Install bladder into re-usable paint cup
3. Mix formula into paint cup
4. Reduce material in paint cup
5. Grab and attach spray lid to cup along with sealing ring—it takes 4 separate pieces to assemble this cup and is cumbersome. The cup is now ready to be assembled to the spray gun for paint application.
6. Attach paint cup to spray gun and it is ready to paint
7. To tint this mixed formula, set cup back on bench and detach spray gun from the component
8. The lid and sealing ring need to be removed for access to paint—the 2 pieces become cumbersome if this process has to be done several times
9. Add tints to paint mixture, re-assemble cup
10. Attach spray gun to paint cup and you're ready to spray
11. The color coat is finished and it's time to clean up the gun
12. The spray gun is detached from the paint cup
13. The 2 piece lid and sealing ring are removed
14. The paint bladder is removed from the paint cup and the spray lid without the sealing ring is placed on top for dust contamination control
15. This bladder is made of very thin, very flexible material and is not condusive for paint storage. If the bladder is touched slightly it will cause it to fall over, causing a large mess or hazardous spill. Also, There is no way to stack these bladders for storage for 2 reasons; The sides of the bladder are not strong enough to stack anything on. The spray lid is an uneven surface and will not allow anything to be stacked on top of it and therefore storage is a huge problem.
16. The gun can now be cleaned. This system has addressed the ability to detach the expensive clean up part, the paint cup. Clean up will only be necessary on the spray gun head itself. However, even though they use a bladder, it may still be necessary to clean the exterior surface of the container each time, which is again very time consuming and costly.
17. If the owner wants touch up paint, the bladder needs to be pulled off the shelf, stirred, and then transferred to a smaller touch up bottle. This again is messy because the bladder is very flexible, difficult to handle, and pouring from one container to the next is very messy.
18. The bladder is then put back onto the shelf, hoping it doesn't get spilled in the meantime.
19. The mixed paint must now be disposed of by having an offsite company come and pick up the waste or house an onsite recycler.
20. Pour paint into a tin can for storage.

The above concept addresses the time consuming and expensive process of cleaning the paint cup. However, it is very cumbersome to use, (too many pieces), and has no safe way for storage. Also, it doesn't have the capacity for paint touch up.

One advantage of the above noted system, is that with the bladder style the painter can turn the gun upside down to paint with. However, painters have not turned the guns upside down for over 60–70 years, so this is not really an advantage.

Newest Way Steps that Would be Eliminated

Con's

1. Cumbersome assembly time to set up spray cup to spray
2. If materials were to be saved safely, a tin can would need to be used to put materials in and the bladder system thrown away.
3. A touch up bottle still needs to be purchased to give to customer for their personal use.
4. Pouring into touch up bottle eliminated.

Cumbersome to use—4 pieces (ours 2)
No touch up bottle
No storage ability

Pro's

1. The step this process saves is the paint cup clean up.
2. Can turn paint gun upside down.
3. Do not have to clean up spray cup, other than the bladder holder—this saves a little time and materials, but not much.

The New Method of Mixing Spraying Cleaning, Storage and Touch up of the Present Invention 1. Pull plastic can and lid from wall mount container
2. Mix paint into container (paint cup)
3. Reduce paint materials inside paint cup
4. Attach spray lid to paint cup (1 piece lid with no bladder)
5. Attach spray gun to paint cup—easy to use—only 2 pieces for spray cup and lid-ready to paint
6. To tint, detach spray gun from paint cup and remove spray lid. Add tints, mix, and attach spray lid and spray gun.
7. The color coat is finished and ready to clean and store paint.
8. The spray gun is removed from spray cup. The spray lid is removed because it has an uneven surface. The paint storage and brush touch up lid is attached to spray cup (at this time attach brush to storage lid which is child proof and twists on.) Drop marble into spray cup to stir paint after sitting in storage.
9. Set spray cup in storage and now it has a safe container to store materials and can be stacked in storage.
10. Now the spray gun can be cleaned quite easily, quickly, and cheaply.
11. If the owner wants touch up paint, the paint container can be pulled from storage and given directly to the custome—no mess pouring from one container to the next. The lid twists off so no screwdriver is needed and there is no need to hammer on the lid (therefore no paint splatters all over and no extra waste to dispose of) The consumer now has a useful bottle for touch up paint for their vehicle.

Brief Description

Our system has the fewest parts to assemble for the spraying process. It also allows for safe, stackable storage of the paint mixture. It is the least messy system and allows for a touch up kit to be given to the customer with a child proof lid, touch up brush, and marble. VS. the newest way=less cumbersome, fewer pieces and allows for safe, stackable storage. No messy pouring into touch up bottle.

Pro's

1. Fewest pieces
2. No clean up of spray cup
3. No tin can to throw away
4. No purchase of touch up bottle
5. Saves time and material for clean up Con 's Can't turn spray gun upside down

SUMMARY OF THE INVENTION

It is therefore a primary object of the present invention to provide a new and improved liquid storage, dispensing, mixing, application, system which is simple to use, and provides unique container(s) that serve multiple uses all in one, such as the containers can be used for mixing, straining, spraying, storage, etc.

Yet another object of the present invention is to provide a new and improved liquid storage, dispensing, mixing, application, system which includes use of a novel storage holder for containment of the noted container(s). The holder when not in use is very compact, portable and stackable for conventional storage. Also, when the holder is in use, it can be easily removably attached and supported by any suitable support surface of user choice, such as the holder may be attached onto a wall, or the like.

A further object of the present invention is to provide additional compartments within the noted storage holder for containment of articles of user choice, such as lids, application brushes, and/or marbles.

Still another object of the present invention is to provide a new and improved liquid storage, dispensing, mixing, application, system that reduces overall costs typically incurred with today's standard systems.

Also, a further object of the present invention is to provide a new and improved liquid storage, dispensing, mixing, application, system which eliminates timely cleaning of the conventional spray cup, or container, and reduces cleaning to only the typical spray gun head. This further reduces the clean-up time and the quantity of cleaning supplies required.

Yet another object of the present invention is to provide a new and improved liquid storage, dispensing, mixing, application, system that does not require the worker to learn any additional specialized skills and/or knowledge.

Still another object of the present invention is to provide a new and improved liquid storage, dispensing, mixing, application, system wherein the noted container(s) are preferably made from translucent materials so the user can easily visually determine the amount and color of the contents within the container(s).

Also another object of the present invention is to provide a new and improved liquid storage, dispensing, mixing, application, system wherein the noted container(s) may be equipped with child-proof open/closure means so as to reduce the incidence of accidental opening thereof.

A further object of the present invention is to provide a new and improved liquid storage, dispensing, mixing, application, system wherein the noted container(s) also include an additional removably attached touch-up-brush, which allows each of the container(s) to be converted into a touch-up bottle. This not only saves the additional expense of environmentally safe disposal fees that are quite expensive but also pleases the end user, as the contents are a perfect match for their personal use. This is of course dependant upon state and federal regulatory laws.

Yet a further object of the present invention is to provide a new and improved liquid storage, dispensing, mixing, application, system wherein the container(s) are functional without the need for an internal bladder, as each of the container(s) include vent means which proves to be much more efficient and cost effective.

Other objects and advantages will be seen when taken into consideration with the following drawings and specifications.

DETAILED DESCRIPTION OF THE DRAWINGS

Referring now in detail to the drawings wherein like characters refer to like elements throughout the various views. As depicted herein, (10) is an overview of the liquid storage, dispensing, mixing, application, system of the present invention, which includes in combination a support holder (12), multiple container(s) (14) each of which are used for containment of a liquid, spray lid(s) (22) and a prior art spray gun (16), with the spray gun being depicted in ghost lines as it is existing prior art.

With reference to support holder (12), it is to be understood that any support holder of engineering choice may be used but it is preferred that the following characteristics be incorporated into the embodiment for function and efficiency. Support holder (12) is to be made from any suitable flexible material of choice, such as cloth, plastic, Nylon, Neoprene™, etc. The only requirement for the material is that it is strong, durable, tear-resistant and will allow support holder (12) to be unfolded into a first open position (see FIGS. 1–3) or folded into a second closed compact position (see FIG. 4). It is to be noted that support holder (12) when not in use may be simply folded up without any container(s) (14) and stored in a compact manner as shown in FIG. 4.

Figure 2:
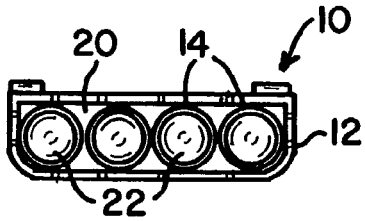
FIG. 2 is a top view of FIG. 1.
Figure 3:
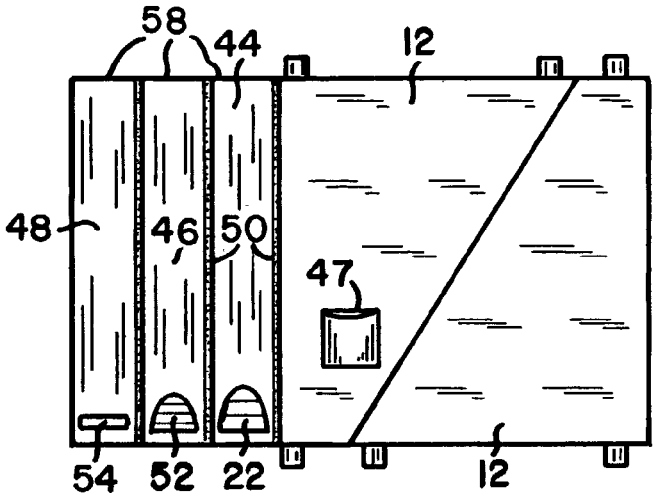
FIG. 3 is a plan view depicting two support holders when positioned side-by-side and having additional removable accessory compartments.
Figure 4:
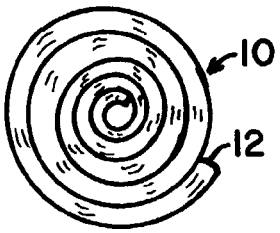
FIG. 4 is a plan view depicting a compact rolled position for the support holder.

However it may be preferred that at the point of manufacture, the support holder (12) is stored in the unfolded first open position with containers (14) therein, as depicted in FIGS. 2 & 3. This has the advantage that multiple support holders (12) may be positioned side-by-side one on top of the other for storage purposes. As can be seen in FIG. 3, if two support holders (12) are positioned in a side-by-side relationship, in combination they conveniently form substantially a square. This is further advantageous as this arrangement allows not only convenient storage but also provides that the stacked support holders (12) can be easily transported and/or stacked on conventional pallets.

Figure 1:
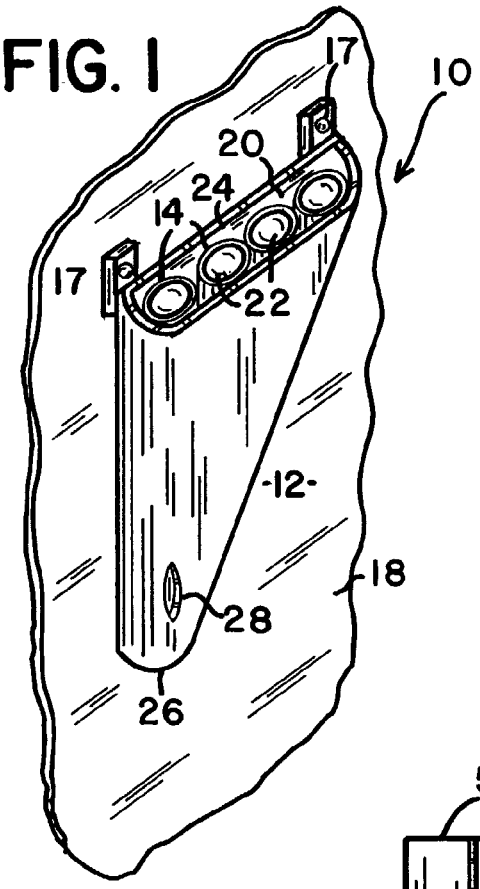
FIG. 1 is a perspective overview of a first embodiment for the present invention.

Support holder (12) further includes attachment means thereon for removably attaching support holder (12) onto a support surface. It is to be understood that any suitable type of attachment means of engineering choice may be used, such as any standard fastening means including nails, screws (17), nuts & bolts, staples, hooks, brackets, adhesives, hook and loop, or any combinations thereof. Also, the noted support surface can be any suitable support surface of user choice, such as a wall (18) or the like. As can be seen in FIGS. 1 & 2, support holder (12) forms an internal compartment (20) which is used for storing container(s) (14). Whereby, support holder (12) substantially functions as a funnel having an enlarged top opening (24) for receiving containers(s) (14) therein and a smaller bottom opening for dispensing one of the container(s) (14) there from one at a time. As can be seen in FIG. 1, this arrangement allows each of the container(s) (14) to be dispensed in an easy manner. However, it may be convenient to include at least one manual access slot (28) that allows a worker to insert their fingers and/or hand therein and manipulate the position of the container (14) that is to be dispensed there from. This is useful and functional if the container does not align itself properly and allow for easy manual withdrawal.

As further depicted in FIG. 3, support holder (12) may also include accessory compartments for containment of additional articles of user choice. For example, the present system includes use for a first lid, a second lid and an application brush, each of which will later be described herein. Therefore, it would be most advantageous to include individualized separate compartments for storage of the noted lids and brushes and/or other articles such as marbles, or the like. Thus, as shown in FIG. 3, (44) is a first accessory compartment, (46) is a second accessory compartment, (48) is a third accessory compartment and (49) is a fourth compartment. It is to be noted that each of the compartments (44, 46, 48 & 49) may be incorporated into the structure of the support holder (12) according to engineering preferences, thus the configuration as taught herein is only exemplary of one possible embodiment, but the invention is not to be limited thereto. It is further advantageous if each the compartments (44, 46, 48 & 49) can be interchangeable so as to allow the consumer or end user, to arrange the compartments according to there liking. Therefore, it may be desirable to produce each of the compartments separately and include attachment means for interconnecting each of the compartments into various configurations of choice. Again, any suitable attachment means of engineering choice may be used, such as hook and loop fasteners (50), or the like.

Thus as depicted herein, (44) is first compartment for containment of multiples of spray lid(s) (22), (46) is a second compartment for containment of multiples of storage lid(s) (62), (48) is a third compartment for containment of multiples of application brushes (54) and (49) is a fourth compartment for containment of marbles (not shown). As can be clearly seen, each of the compartments (44, 46, & 48) also include an outlet opening (56) for dispensing the contents there from and an inlet opening (58) for inserting the contents therein. While compartment 49 may simply be in form of a removable pocket, or the like.

Referring now to each of the container(s) 14, which again may be made from any suitable material of engineering choice. However, it is preferable that each of the container(s) (14) be made from a translucent non-breakable material, such as clear plastic or the like. This is important as this allows the workman to easily visually determine the contents of each container(s) (14), as each of the containers (14) may contain a different composition of liquid therein, depending on the particular situation and/or desired end use. Again, this system can be used with any type of liquid of user choice, such as paint or the like. Furthermore, each of the container(s) (14) include attachment means for removably attaching a spray lid (22) thereto and each of the spray lid(s) (22) include attachment means thereon for removably attaching a spray gun (16) thereto.

As noted above, each of the container(s) (14) include attachment means for removably attaching a spray lid (22) thereto. Accordingly, any suitable attachment means of engineering choice may be used, as there are numerous types of acceptable lid designs to choose from. Thus, the following is only exemplary of one functional attachment means but the invention is not to be limited, thereto.

Figure 5:
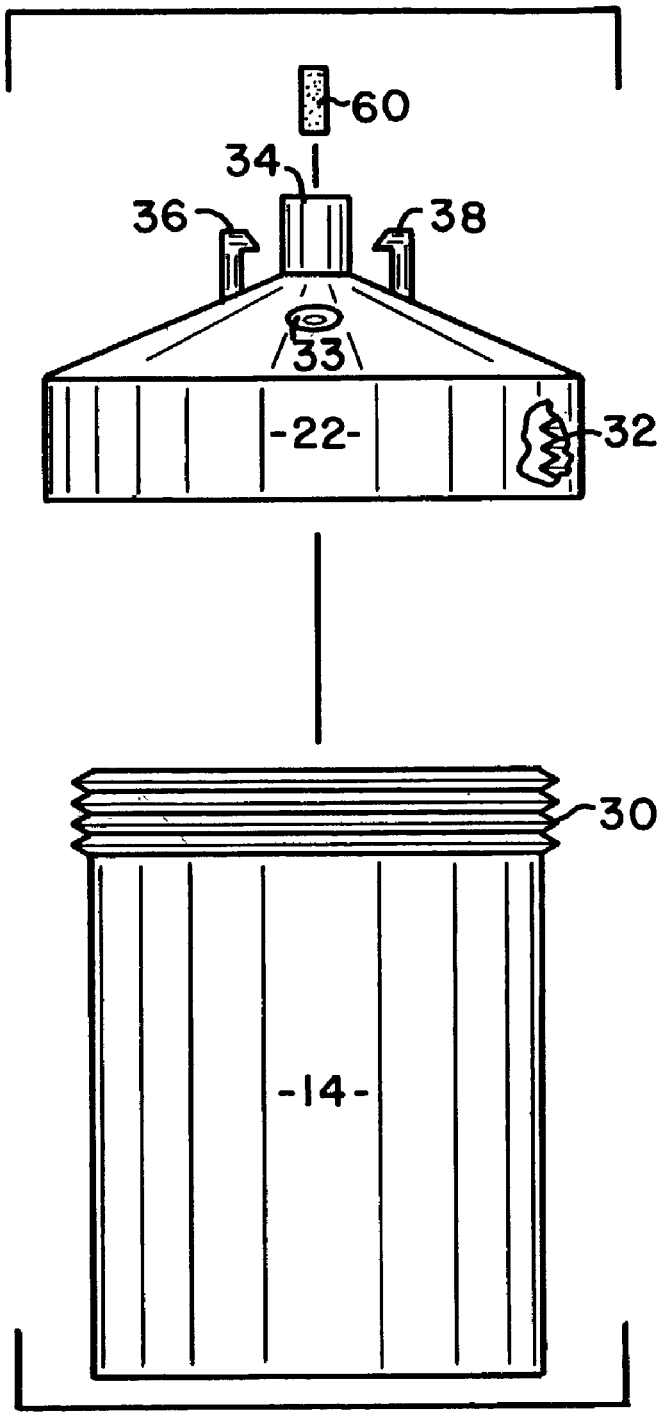
FIG. 5 is a plan view depicting a container and a first lid.

As depicted in FIG. 5, container(s) (14) each have a circular open top which provides an inside diameter and an outside circumference area. The circumference area of container (14) includes external threads (30) and the spray lid (22) includes internal threads (32) and external threads (30)

and internal threads (32) have a mating relationship when threadably engaged together. It is to be understood any suitable type of thread design may be used, however for safety measures it may be an advantage to make a childproof thread design. Again, there are so many variants of such designs that any can be incorporated, such as those which must be pressed down while turning, or the like.

With further reference to container(s) (14) it is to be noted that the present invention does not need an internal bladder, as most similar containers require. However, it is advantageous to include an air-vent mechanism (33) for improved function. Again, there are so many variants of suitable air-vent mechanisms and there function is very well known in the art, thus we do not disclose the particulars for function herein.

Figure 6:
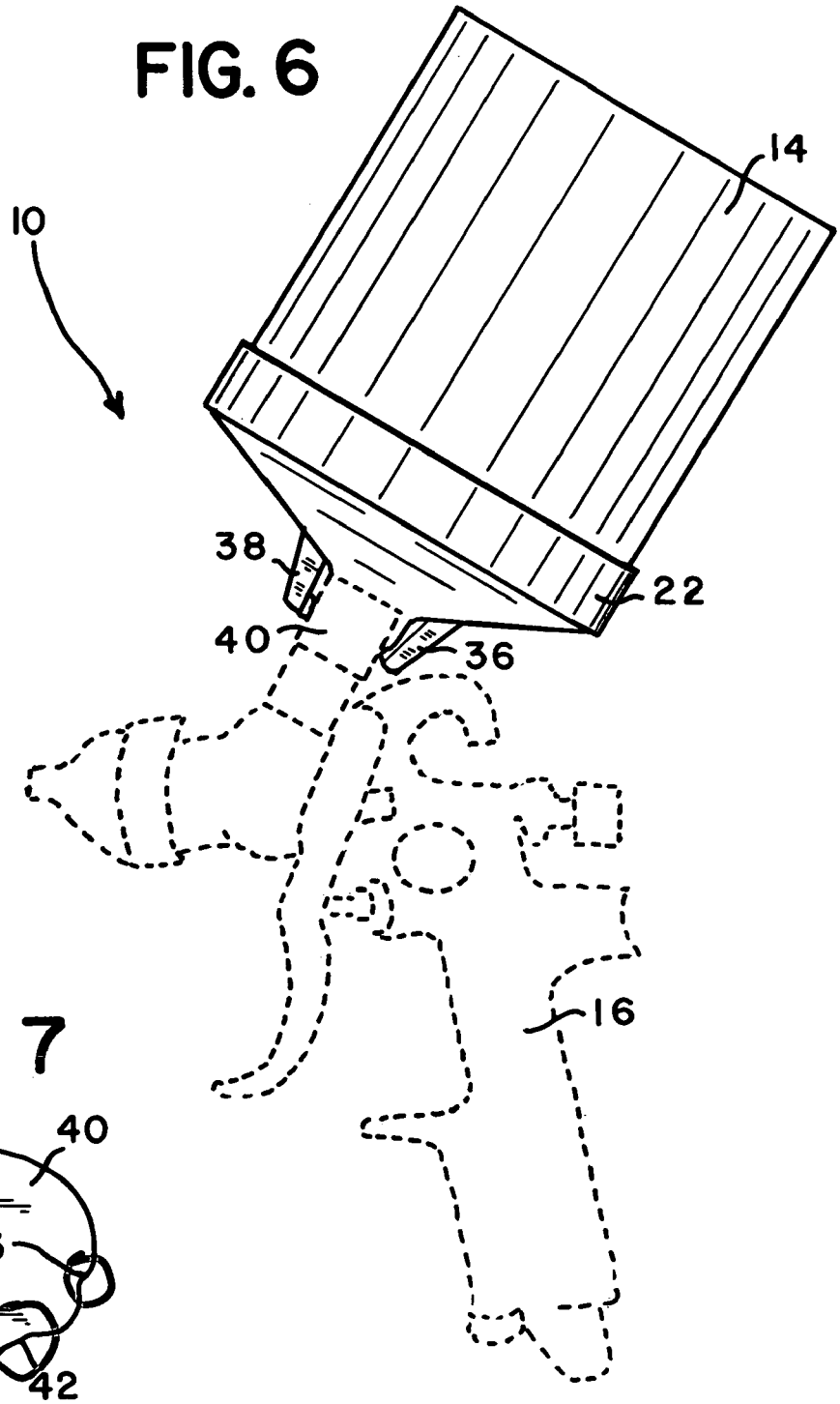
FIG. 6 is a plan view depicting a container when attached to a prior art air gun.
Figure 7:
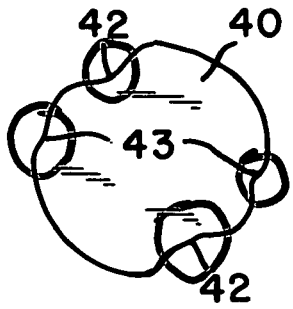
FIG. 7 is a top view of an air gun attachment fitting.

Within the afore mentioned specification the noted attachment means for removably attaching a spray gun (16) onto spray lid (22) is as follows: as depicted in FIG. 5, spray lid (22) includes an upraised hollow protuberance (34), a first grasping arm (36) and a second grasping arm (38). First grasping arm (36) is substantially opposed to second grasping arm (38) and upraised hollow protuberance is substantially centrally located between the first grasping arm (36) and second grasping arm (38). With regard to the spray gun (16), it is to be understood any suitable type of spray gun may be used, such as a typical prior art air spray gun as depicted in FIG. 6. Spray gun (16) includes an attachment fitting (40), (refer to FIG. 7) thereon, which has a first pair of opposed indents (42) and a second pair of opposed indents (44). Attachment fitting (40) is of a shape and size to be slidably engaged onto upraised protuberance (34) when the first pair of indents (42) and each grasping arm (36 & 38) are in alignment, and when the attachment fitting (40) is slightly rotated, each grasping arm (36 & 38) is frictionally forced into a locked position within the second pair of indents (43) and the attachment fitting assumes a locked position. Whereby, container (14), spray lid (22), upraised protuberance (34), attachment fitting (40), and spray gun (16) cooperate together in combination to direct a liquid (not shown) outwardly from within container (14) into spray gun (16) and then the liquid is dispersed outwardly from within spray gun (16) in a controlled manner, as depicted in FIG. 6.

It is to be understood that additional components maybe incorporated into the present system if needed, depending on the particular use thereof. For example, when the system is used with paint or the like, it is advantageous to include within first lid (22) a filter means, such as filter (60) which again is well known and clearly taught within the prior art.

As previously noted the preferred embodiment for the present invention may include use of a second lid configuration, application brushes and marbles. It is to be understood the system as depicted in FIG. 1, teaches that the container(s) (14) may be stored in support holder (12) with spray lid(s) (22) fixedly secured onto their respective container(s) (14). However, this may not be desirable as this requires more space and also the first lid configuration is difficult to stack. Thus we include a second lid configuration which provides novel end results, as will be seen within the following specification.

Figure 8:
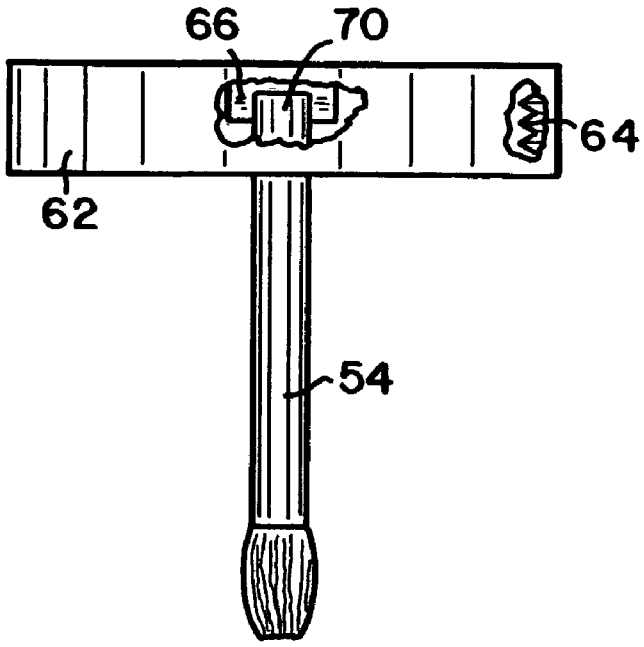
FIG. 8 is a partial cut-a-way side view of a second lid configuration including an application brush.

Referring now to FIG. 8, wherein we teach a second lid configuration substantially comprising of a storage lid (62) having internal threads (64) and a central internal receptacle (66). As previously described, container(s) (14) each have a circular open top which provides an inside diameter and an outside circumference area. The circumference area of container (14) includes external threads (30) and the storage lid (62) includes internal threads (64) and external threads (30) and internal threads (64) have a mating relationship when threadably engaged together. It is to be understood any suitable type of thread design may be used, however for safety measures it may be an advantage to make a childproof thread design. Again, there are so many variants of such designs that any can be incorporated, such as those that must be pressed down while turning, or the like. It is to be understood that the second lid configuration is very advantageous as this allows for easy storage, it is safe, and is especially useful as it converts the container from being a spray bottle into being a storage touch up bottle with application brush.

Figure 9:
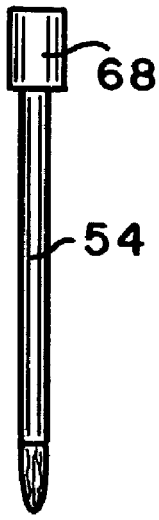
FIG. 9 is a side view of a second embodiment for the application touch-up brush.

Referring now to the noted application brush(s) (54), which as previously stated when not in use may be stored within a compartment (48) of support holder (12) and each of the lid(s) (22 & 62) have attachment means for removably attaching one of the application brush(s) (54) thereto. For versatility purposes we herein provide a first and second embodiment for constructing the application brush(s) (54) as each provide a different function and purpose. In the first embodiment as depicted in FIG. 9, we teach each one of the application brush(s) (54) having an affixed externally threaded circular plug member (68). The noted attachment means for removably attaching one of the application brush (s) (54) onto spray lid(s) (22) includes spray lid(s) (22) having an upraised internally threaded hollow protuberance (34) and affixed externally threaded circular plug member (68) being of a shape and size to be threadably engaged within upraised internally threaded hollow protuberance (34). Whereby, when affixed externally threaded circular plug member (68) is engaged within upraised internally threaded hollow protuberance (34), container(s) (14) is substantially air-tight and the container(s) (14) is now converted from being a spray container into being a touch up bottle.

The second embodiment for the application brushes is depicted in FIG. 8. Wherein the application brush(s) 54 includes a first end (70) which is of a shape and size to be removably frictionally engaged within central internal receptacle (66) of storage lid(s) (62). It can now be seen this is very advantageous as this converts the spray container(s) (14) into being a touch up bottle which can be utilized by the end user.

As stated herein, the present system also teaches a simplified method of use comprising the steps of:

a. removing a container (14) from support holder (12)
b. removing a spray lid member (22) from support holder (12);
c. pouring paint into container (14);
d. reducing paint in container (14) using reducers and/or hardeners;
e. attaching spray lid member (22) onto container (14);
f. attaching a spray gun (16) onto spray lid member (22);
g. painting;
h. removing spray gun (16) from container (14);
i. removing spray lid member (22) from container (14);
j. removing a storage lid member (62) from support holder (12);
k. removing an application brush (54) from support holder (12);
l. attaching application brush (54) onto storage lid member (62)
m. inserting a marble into container (14);
n. attaching storage lid member (62) onto container (14);
o. delivering the container (14) to the end user; and;
p. cleaning spray lid (22) and spray gun (16).

The above noted method may be somewhat modified, depending on the particular situation. For example, if the worker must also tint, then between steps (g) and (h) the following additional steps are involved:

a. detaching spray gun (16) from spray lid (22);
b. detaching spray lid (22) from container (14);
c. adding tints into container (14);
d. mixing contents;
e. attaching spray lid (22) onto container (14);
f. attaching spray gun (16) onto spray lid (22); and;
g. tinting.

Although the invention has been herein shown and described in what is conceived to be the most practical and preferred embodiment, it is recognized that departures may be made there from within the scope and spirit of the invention, which is not to be limited to the details disclosed herein but is to be accorded the full scope of the claims so as to embrace any and all equivalent devices and apparatuses.

Having described our invention, what we claim as new and desire to secure by LETTERS PATENT:

1. In combination, a liquid storage, dispensing, mixing, application, system comprising: a support holder; containers; spray lids; and a spray gun having an attachment fitting thereon; said support holder having fastening means for removably attaching said support holder onto a support surface, said support holder forming an internal compartment, said internal compartment being used for storage of said containers, said containers each being made from a translucent non-breakable material, each said containers having attachment threads for removably attaching one of said spray lids onto one of said containers, said spray lids each having attachment means thereon for removably attaching said attachment fitting onto one of said spray lids, said support holder functions as a funnel having an enlarged top opening for receiving said containers therein and a smaller bottom opening for dispensing one of said containers there from, said support holder is made from a flexible material which can be unfolded into a first open position and folded into a second closed compact position, and said fastening means being either nails, nuts, bolts, staples, hooks, brackets, adhesives, hook and loop, or combinations thereof.

2. The system according to claim 1 wherein said support holder further includes at least one manual access slot for manual manipulation there through.

3. The system according to claim 1 wherein each said containers having attachment threads for removably attaching said spray lids onto said containers comprising: said containers each having a circular open top which provides an inside diameter and an outside circumference area, said outside circumference area having external threads, said spray lids each having internal threads, and said external threads and said internal threads having a mating relationship when threadably engaged.

4. The system according to claim 1 wherein said attachment means for removably attaching said spray attachment fitting onto one of spray lids comprising: each said spray lids having an upraised hollow protuberance; a first grasping arm; and a second grasping arm; said first grasping arm being opposed to said second grasping arm, said upraised hollow protuberance being centrally located between said first grasping arm and said second grasping arm, said attachment fitting having a first pair of opposed indents and a second pair of opposed indents, said attachment fitting being of a shape and size to be slidably engaged onto said upraised protuberance when said first pair of indents and each said grasping arm are in alignment, and when said attachment fitting is slightly rotated each said grasping arm is frictionally forced into a locked position within said second pair of indents and said attachment fitting assumes a locked position:

whereby:

one of said container(s), one of said spray lids, said upraised hollow protuberance of said one of said spray lids, said attachment fitting, and said spray gun cooperate together in combination to direct a liquid outwardly from within said one of said containers into said spray gun, and said liquid is then dispersed outwardly from within said spray gun in a controlled manner.

5. The system according to claim 1 wherein said support holder further includes a compartment for containment of application brushes, and said spray lid(s) each having attachment means for removably attaching one of said brushes thereto.

6. The system according to claim 5 wherein said attachment means for removably attaching one of said brushes thereto comprising: each one of said application brushes having an affixed circular plug member, said spray lid(s) each having an upraised hollow protuberance, and said affixed circular plug member being of a shape and size to be frictionally engaged within said upraised hollow protuberance, whereby:

when said affixed circular plug member is engaged within said upraised hollow protuberance, said container(s) is now converted from being a spray container into a touch up bottle.

7. The system according to claim 1 wherein said spray lids each further include an air-vent valve mechanism.

8. The system according to claim 1 wherein said spray lids each further include a filter.

9. The system according to claim 1 wherein said attachment means for removably attaching said spray lid(s) onto said container(s) is child proof.

10. The system according to claim 11 wherein said support holder substantially functions as a funnel having an enlarged top opening for receiving said container(s) therein and a smaller bottom opening for dispensing one of said container(s) there from.

11. The system according to claim 1 wherein said support holder is made from a flexible material which can be unfolded into a first open position and folded into a second closed compact position, and said attachment means for removably attaching said support holder onto a support surface comprising: one of the following standard fastening means: nails, nuts, bolts, staples, hooks, brackets, adhesives, hook and loop, or combinations thereof.

12. The system according to claim 11 wherein said support holder further includes at least one manual access slot for manual manipulation there through.

13. The system according to claim 1 wherein said attachment threads for removably attaching one of said spray lids onto one of said containers comprising: said containers each having a circular open top which provides an inside diameter and an outside circumference area, said outside circumference area having external threads, said spray lids each having internal threads, and said external threads and said internal threads having a mating relationship when threadably engaged.

14. The system according to claim 1 wherein said attachment threads for removably attaching one of said storage lids onto one of said containers comprising: said containers each having a circular open top which provides an inside diameter and an outside circumference area, said outside circumference area having external threads, said storage lids each having internal threads, and said external threads and said internal threads having a mating relationship when threadably engaged.

15. The system according to claim 1 wherein said attachment means for removably attaching said attachment fitting onto one of said spray lids comprising: each said spray lids having an upraised hollow protuberance; a first grasping arm; and a second grasping arm; said first grasping arm being opposed to said second grasping arm, said upraised hollow protuberance being centrally located between said first grasping arm and said second grasping arm, said attachment fitting having a first pair of opposed indents and a second pair of opposed indents, said attachment fitting being of a shape and size to be slidably engaged onto said upraised protuberance when said first pair of indents and each said grasping arm are in alignment, and when said attachment fitting is slightly rotated each said grasping arm is frictionally forced into a locked position within said second pair of indents and said attachment fitting assumes a locked position:

whereby:

one of said container(s), one of said spray lids, said upraised hollow protuberance of said one of said spray lids, said attachment fitting, and said spray gun cooperate together in combination to direct a liquid outwardly from within said one of said containers into said spray gun, and said liquid is then dispersed outwardly from within said spray gun in a controlled manner.

16. The system according to claim 1 wherein said support holder further includes a compartment for containment of application brushes.

17. The system according to claim 1 wherein said support holder further includes a compartment for containment of said spray lids.

18. The system according to claim 1 wherein said support holder further includes a compartment for containment of said storage lid(s).

19. The system according to claim 1 wherein said support holder further includes a compartment for containment of marbles.

20. The system according to claim 16 wherein said compartment is removably attachable onto said support holder.

21. The system according to claim 17 wherein said compartment is removably attachable onto said support holder.

22. The system according to claim 18 wherein said compartment is removably attachable onto said support holder.

23. The system according to claim 19 wherein said compartment is removably attachable onto said support holder.

24. The system according to claim 16 wherein said compartment is removably attachable onto said support holder by a hook and loop fastener.

25. The system according to claim 16 wherein said compartment is removably attachable onto said support holder by a hook and loop fastener.

26. The system according to claim 17 wherein said compartment is removably attachable onto said support holder by a hook and loop fastener.

27. The system according to claim 18 wherein said compartment is removably attachable onto said support holder by a hook and loop fastener.

28. The system according to claim 19 wherein said compartment is removably attachable onto said support holder by a hook and loop fastener.

29. The system according to claim 1 wherein said support holder further includes multiple compartments which may be removably interconnected together and combined into different configurations.

30. The system according to claim 1 further includes said storage lid(s) each having attachment means for removably attaching one of said application brushes thereto.

31. The system according to claim 30 wherein said attachment means for removably attaching one of said brushes thereto comprising: each one of said application brushes having a first end which is of a shape and size to be removably frictionally engaged within a central internal receptacle of storage lid(s)

whereby:

when said first end is engaged within said central internal receptacle, said container(s) is now converted from being a spray container into a touch up bottle with brush.

32. The system according to claim 1 wherein said spray lids each further include an air-vent valve mechanism.

33. The system according to claim 1 wherein said spray lids each further include a filter.

34. The system according to claim 1 wherein said attachment means for removably attaching said storage lid(s) onto said container(s) is child proof.

* * * * *